United States Patent [19]

Delia

[11] Patent Number: 4,577,769

[45] Date of Patent: Mar. 25, 1986

[54] CHILD RESISTANT CONTAINER

[75] Inventor: Anthony Delia, West Redding, Conn.

[73] Assignee: The Drackett Company, Cincinnati, Ohio

[21] Appl. No.: 716,277

[22] Filed: Mar. 26, 1985

[51] Int. Cl.[4] ..... B65D 55/02

[52] U.S. Cl. ..... 215/211; 215/295; 220/307; 220/260

[58] Field of Search ..... 215/211, 206, 224, 295, 215/296; 220/307, 260

[56] References Cited

U.S. PATENT DOCUMENTS

| | | | |
|---|---|---|---|
| 3,398,848 | 8/1968 | Donovan | 215/224 |
| 3,759,411 | 9/1973 | Horvath . | |
| 3,976,216 | 8/1976 | Lambert | 215/307 |
| 4,043,474 | 8/1977 | McCord . | |
| 4,315,578 | 2/1982 | Ludwig, Jr. . | |
| 4,401,225 | 8/1983 | Schwaikert . | |

*Primary Examiner*—George T. Hall
*Attorney, Agent, or Firm*—Charles J. Zeller

[57] ABSTRACT

A child resistant closure construction for one end of a container, such as a cylindrical container. A removable plug normally closes a dispensing opening at one end of the container, the plug provided with a radially extending ear. The plug and ear are so configured that removal of the plug by a child is difficult because there is no easy method to firmly manually grasp any portion of the plug. A raised abutment is integrally carried by the end closure of the container. Upon rotation of the closure plug to a certain angular position, the ear strikes the abutment and the ear tilts away from the container interior to thereby enable it to be grasped and pulled to remove the closure plug.

11 Claims, 7 Drawing Figures

CHILD RESISTANT CONTAINER

This invention relates to a child resistant closure construction. In such construction, a container is provided with a cap or plug or other closure element, with the construction being such that the closure plug is difficult for a child to remove. Some manipulative step, too complex for most children, is required on the part of the user to remove the closure plug. For example, the user may have to align an indicia mark on the plug with a corresponding indicia mark on the container prior to plug removal. A great variety of child resistant container constructions has evolved, due in large part to federal packaging regulations for medicaments or inherently dangerous substances such as some chemicals.

According to the present invention, a child resistant closure construction is particularly adopted for containers having a rigid closure on one end, with the closure (for example, sheet metal) being provided with a dispensing opening. A plug is insertable into the dispensing opening to normally close the container. The plug is provided with an integral and radially extending ear, with the plug being relatively easily rotatable in the dispensing opening, but otherwise not being easily removable with respect to the opening, so that it normally remains in place. A raised abutment is provided on that portion of the container closure which is between the dispensing opening and the rim of the container. Upon rotation of the closure plug to a certain angular position, the ear, (usually integral with the closure plug) tilts upwardly, to thereby enable it to be grasped. Upon pulling of the ear the closure plug may be removed and the contents of the container dispensed. Alternatively, the integral ear carried by the closure plug may be rigid with respect to the closure plug so that upon the striking of the abutment by the ear upon rotation of the closure plug, the closure plug also tilts upwardly, so that it, as well as or instead of the ear, may be grasped and pulled for removal of the plug.

The closure plug is provided with a lip at its lowermost periphery of the dispensing opening to prevent plug removal. The construction of the lip is such that the closure plug can only rotate in its normal (closed) position, yet the lip will yield sufficiently to permit plug removal upon the application of sufficient pulling force by the user on the plug.

IN THE DRAWINGS

Figure 1:
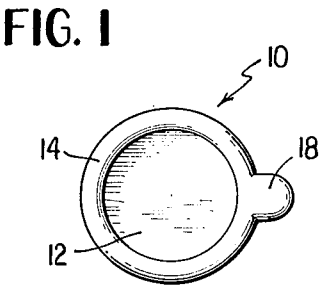
FIG. 1 is a plan view of the closure plug according to the practice of this invention.
Figure 2:
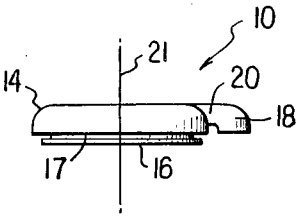
FIG. 2 is a side elevational view of the plug of FIG. 1.

Referring now to the drawings, the numeral 10 denotes generally the closure plug of this invention, the plug typically formed of a rigid or semi-rigid material. Typical materials of construction for the closure plug include metal or a synthetic resin, such as a low density polyethylene or a polyester elastomer or polyurethane. The numeral 12 denotes generally a central flattened portion or recess of the plug, while the numeral 14 denotes an upstanding annular shoulder to limit the depth of insertion of the plug into the dispensing opening, the latter to be presently described. The plug is provided with an integral, radially outwardly extending ear 18, with neck portion 20 coupling ear 18 to rim 14. The numeral 16 denotes an integral rim or lip carried by depending portion 17 of the plug (see FIG. 6). At FIG. 2, the numeral 21 denotes an axis of rotation passing centrally through the plug, it being understood that axis 21 is coincident with the longitudinal axis of the container now to be described, although axis 21 could be displaced from the longitudinal axis of the container.

Figure 3:
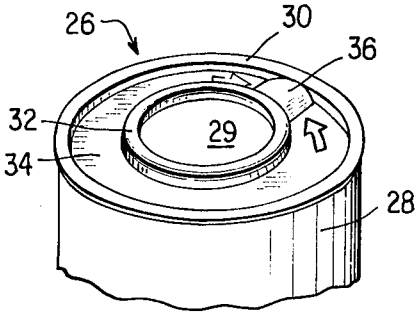
FIG. 3 is a perspective view of the upper portion of a container provided with the present invention.
Figure 6:
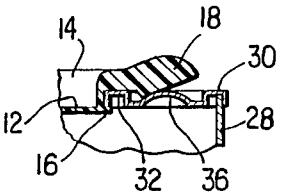
FIG. 6 is a section taken on section 6 of FIG. 5.

Referring now to FIG. 3 of the drawings, a perspective view of a typical container 26 embodying the present invention is shown as defined by a cylindrical container body 28, of any desired material such as paperboard, sheet metal or a synthetic resin similar to the material from which the closure plug 10 is formed. The numeral 29 denotes a dispensing opening generally centrally of container 26. The numeral 30 denotes an outer rim of the container end closure disc 34 while the numeral 32 denotes a radially inner rim around the dispensing opening 29, these rims being radially spaced on container end closure disc 34 with regard to axis 21, and being annularly continuous. As shown at FIG. 6, each rim 30, 32 is of generally inverted U-shape in cross-section. The container end closure disc 34 may be termed a container wall portion.

As shown in FIG. 6, the upper periphery of the cylindrical container wall 28 is suitably secured, as by an adhesive or a press fit, to the radially outermost portion of rim 30. The vertically extending portions of U-rim 30 are shown spaced apart a distance greater than in practice, for purpose of illustration.

Figure 4:
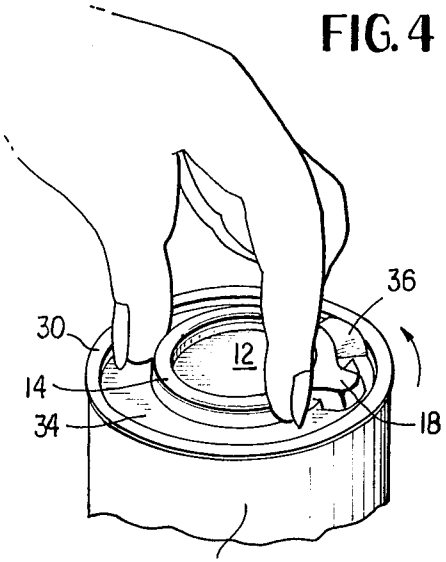
FIG. 4 is a view similar to FIG. 3, illustrating the closure plug of FIG. 1 in its normal position, and illustrating how the plug being grasped to effect rotation of it.

Also, as shown in FIG. 6, closure plug 10 is provided with a lowermost annular lip 16, the lip being integral with depending portion 17 of the plug. The upper peripheral surface of rim 16 abuts the radially innermost portion of rim 32 which is disposed around the dispensing opening. The construction is such that, with lip 16 being relatively deformable with respect to rim 32, an upward pulling on closure plug 10 of sufficient force will result in a deformation of rim 16 and/or deformation of a portion of rim 32, to thereby permit release of the closure plug from the dispensing opening 29. Plug 10 is relatively rotatable in its normal, container closing position, as indicated at FIGS. 4 and 5 and is normally maintained in that portion by rim 16 and shoulder 14.

The numeral 36 denotes a raised abutment on that portion of container end closure 34 which is radially intermediate rims 30 and 32. If closure 34 is fashioned of sheet metal, the abutment is an integral and upwardly rising bulge.

Figure 5:
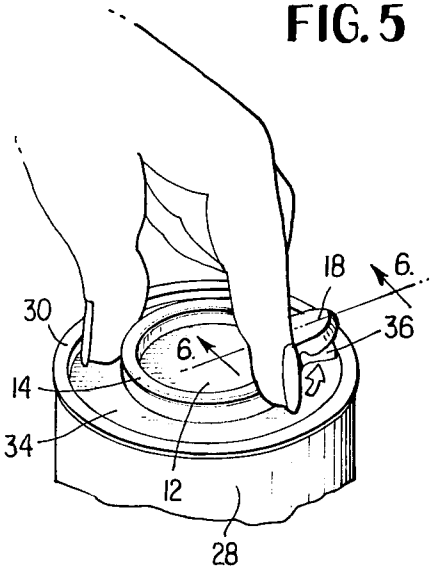
FIG. 5 is a view similar to FIG. 4, showing the upward tilting of the ear carried by the closure plug, when the closure plug reaches a certain angular position with respect to the container, to thereby permit the user to pull out the plug.
Figure 7:
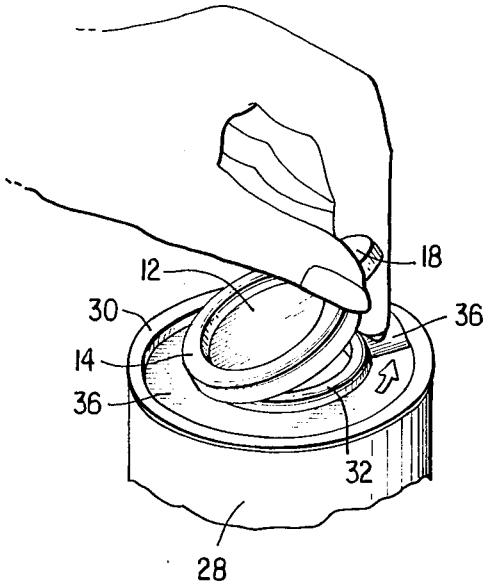
FIG. 7 is a perspective view showing how the plug can be grasped to remove it from the dispensing opening.

Referring now to FIGS. 4–7, the mode of operation of the invention will now be set out. With closure plug 10 in its normal or container-closing position in dispensing opening 29, it is relatively free to rotate in either direction about plug longitudinal axis 21. The configuration of closure plug 10 and its integral ear 18 is such that no firm enough grasp can be made of the plug to pull it and to thereby withdraw it. Thus, it is relatively difficult to remove, without more, for both children and adults. In order to remove the plug, it must be rotated to such an angular position that ear 18 strikes abutment 36 from either rotary direction, to thereby cause the ear to tilt or bend upwardly. As indicated at FIGS. 5 and 6, this upward tilting renders ear 18 relatively easy to be manually grasped and thereby pull the plug from dispensing opening 29. At this point, the reader will readily visualize that ear 18 is relatively bendable with respect to the remainder of closure plug 10. However, it will also be readily appreciated that ear 18 may be rigid with respect to the remainder of the closure plug, so that upon striking the abutment 36, not only will ear 18 tilt upwardly, but the entire plug will be tilted somewhat, as may be readily visualized by reference to FIG. 7 of the drawings. Now, not only the ear but a portion of the plug body may be grasped to pull out the plug. For reinsertion back into the container, the closure plug is tilted somewhat relative to the plane of opening 29 and pushed. Upon leveling of the plug and pushing it into the opening, lip 16 and/or the lower part of rim 32 will deform somewhat to thus permit lip 16 of the plug to lie beneath rim 32 and prevent casual plug withdrawal, i.e., withdrawal without the intended manipulative steps. Lower lip 16 thus serves as a means to lock the plug in the dispensing opening against casual upward withdrawal.

While shown as cylindrical, it will be apparent that the container may assume a variety of cross-sectional forms. It will further be apparent that if the sides of the container are flat, as in the case of a container polygonal in cross-section, the dispensing opening may be placed in one of the sides, instead of being placed on one end of the container as has been illustrated.

What is claimed is:

1. A child resistant closure construction for a container, the container having a wall portion, the wall portion having a circular dispensing opening therethrough, the dispensing opening having a removable and reinsertable closure plug normally positioned therein to close the dispensing opening, the closure plug including locking means to normally maintain it in the dispensing opening against casual upward withdrawal, the closure plug carrying a radially extending ear, the closure plug and ear being capable of executing at least limited angular movement about an axis passing through the center of the circular dispensing opening, an abutment carried by the closure member and being located radially outwardly of the periphery of the circular dispensing opening and being in the annular path of at least a portion of the ear upon angular movement of the ear and closure plug, the abutment and the ear being configured to cause the ear to to tilt away from the container interior, whereby the closure plug and/or the ear can be manually grasped and removed to thereby gain access to the contents of the container.

2. The closure construction of claim 1 wherein the closure plug is provided with means to limit the depth of its insertion into the dispensing opening.

3. The closure construction of claim 1 wherein the container wall portion is formed of sheet material, the material being of metal, a rigid synthetic resin, or paperboard.

4. The closure construction of claim 1 wherein the container wall portion having the dispensing opening is at one end of the container.

5. The closure construction of claim 1 wherein the abutment is a curved bulge which is bulged in a direction away from the interior of the container.

6. The closure construction of claim 1 wherein the closure plug and the ear are integral and are formed of a rigid material.

7. The closure construction of claim 1 wherein the closure plug and ear are formed of a synthetic resin.

8. The closure construction of claim 7 wherein the synthetic resin is a low density polyethylene, a polyester elastomer, or polyurethane.

9. The closure construction of claim 6 wherein the ear is bendable relative to the closure plug.

10. The closure construction of claim 1 wherein said locking means is defined by a radially outwardly extending lip carried by the lower portion of the plug, the lip normally abutting a container interior portion of said wall portion contiguous to the periphery of the dispensing opening.

11. The closure construction of claim 4 wherein said locking means is defined by a radially outwardly extending lip carried by the lower portion of the plug, the lip normally abutting a container interior portion of said wall portion contiguous to the periphery of the dispensing opening.

* * * * *